US007007629B2

(12) United States Patent
Lewis

(10) Patent No.: US 7,007,629 B2
(45) Date of Patent: Mar. 7, 2006

(54) BOAT SEAT DECK BASE

(76) Inventor: Jimmie L. Lewis, 2290 Rockledge Dr., Rockledge, FL (US) 32955

( * ) Notice: Subject to any disclaimer, the term of this patent is extended or adjusted under 35 U.S.C. 154(b) by 0 days.

(21) Appl. No.: 11/071,628

(22) Filed: Mar. 3, 2005

(65) Prior Publication Data

US 2005/0183655 A1 Aug. 25, 2005

Related U.S. Application Data

(63) Continuation-in-part of application No. 10/782,054, filed on Feb. 19, 2004.

(51) Int. Cl.
*B63B 17/00* (2006.01)

(52) U.S. Cl. ..... 114/363; 297/344.22

(58) Field of Classification Search ..... 114/363; 297/344.22
See application file for complete search history.

(56) References Cited

U.S. PATENT DOCUMENTS

| | | | |
|---|---|---|---|
| 5,197,406 A | 3/1993 | Rabal et al. | 114/363 |
| 5,383,644 A | 1/1995 | Huse | 248/523 |
| 5,431,362 A | 7/1995 | Carnahan et al. | 248/159 |

*Primary Examiner*—Jesus D. Sotelo
(74) *Attorney, Agent, or Firm*—Carlson, Gaskey & Olds

(57) ABSTRACT

A deck base for mounting a seat on a deck of a boat is molded from plastic as a single part. A downwardly extending tube receives a pedestal mount from the seat. Structural support is provided to this tube, including a concentric outer tube, and frusto-conical supporting web. The plate portion of the deck base has a caulking groove at its outer periphery.

6 Claims, 2 Drawing Sheets

BOAT SEAT DECK BASE

This application claims priority to U.S. patent application Ser. No. 10/782,054, which was filed on Feb. 19, 2004.

BACKGROUND OF THE INVENTION

This application relates to a deck base for mounting a boat seat to a boat deck, wherein the deck base is molded as a one-piece item, and preferably from a plastic.

Seats are mounted onto a boat deck through an adjustable pedestal. Generally, the pedestal must be able to rotate within its mount, such that the seat itself can rotate.

Typically, a two-piece base is mounted to the deck, with a flat plate on the deck, and a tube extending downwardly through the plate, and into the deck. The tube receives and mounts a portion of the seat pedestal, to mount the seat for rotation relative to the deck. Typically, the tube portion has been welded to the plate.

The use of metal, and the use of the weld joint has many undesirable drawbacks. In particular, the weld joint corrodes quickly, as does a good deal of the surface area of the tube and plate. Further, the weld joint provides a break point between the tube and the plate, as forces are transmitted from the seat to the tube or plate.

The prior art deck bases have required replacements every few years due to the corrosion problem. The problem becomes particularly acute in saltwater environments. Moreover, particularly with corrosion, there is often breakage between the tube and the plate portion. This is somewhat dangerous, as it tends to occur when the occupant of the seat is applying some force to the seat. That is, the seat often breaks away while someone is sitting in it.

In addition, the metal deck plate is somewhat noisy, and can transfer forces to the deck. This has been a potential cause of damage to the deck in the past.

One other prior art design had a part aluminum plate, with a tube of a second material. However, this also was subject to breakage.

A need therefore exists for a deck base for mounting a seat to a deck that is less susceptible to corrosion and to breakage.

SUMMARY OF THE INVENTION

In a disclosed embodiment of this invention, a deck base and supporting tube for supporting a pedestal of a seat are molded as a one-piece item. Preferably, the item is molded from a suitable plastic. The plastic is corrosion resistant, and the fact that the tube and plate are molded as a single item eliminates any likelihood of breaking as the prior art weld joints. Further, the plastic deck plate eliminates the noise and force transmission problems mentioned above.

In a preferred embodiment, the downwardly extending tube actually includes an inner cylindrical tube portion for supporting the seat pedestal, and structural support radially outwardly of this inner tube. In particular, frusto-conical supporting webs extend from the tube to the plate. Moreover, a second concentric ring is positioned outwardly of the inner tube.

In another feature, a caulking groove is formed in the plate at a laterally outer area. The caulking groove receives caulking as the plate is mounted to the deck, thus providing a more water-tight seal between the plate and the deck.

These and other features of the present invention can be best understood from the following specification and drawings, the following of which is a brief description.

DETAILED DESCRIPTION OF THE PREFERRED EMBODIMENT

Figure 1:
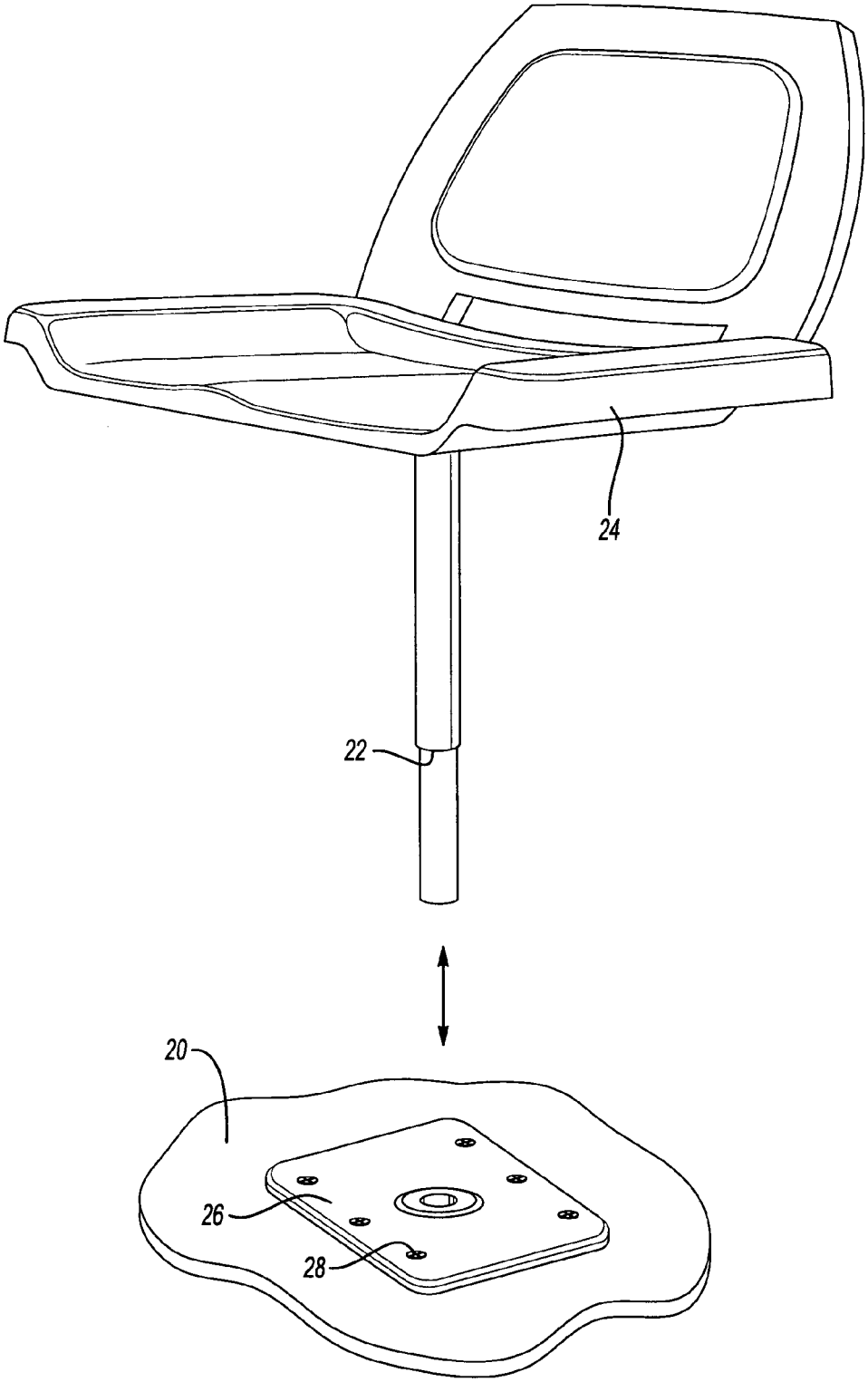
FIG. 1 is a perspective view showing the inventive deck base.

FIG. 1 shows a boat deck 20 having a seat pedestal 22 mounting a seat 24. As known, the seat pedestal 22 is mounted within a deck base 26. Screws 28 are shown securing the deck base 26 to the deck 20. The inventive deck base 26 is molded from a suitable plastic, and thus is not susceptible to corrosion.

Figure 2:
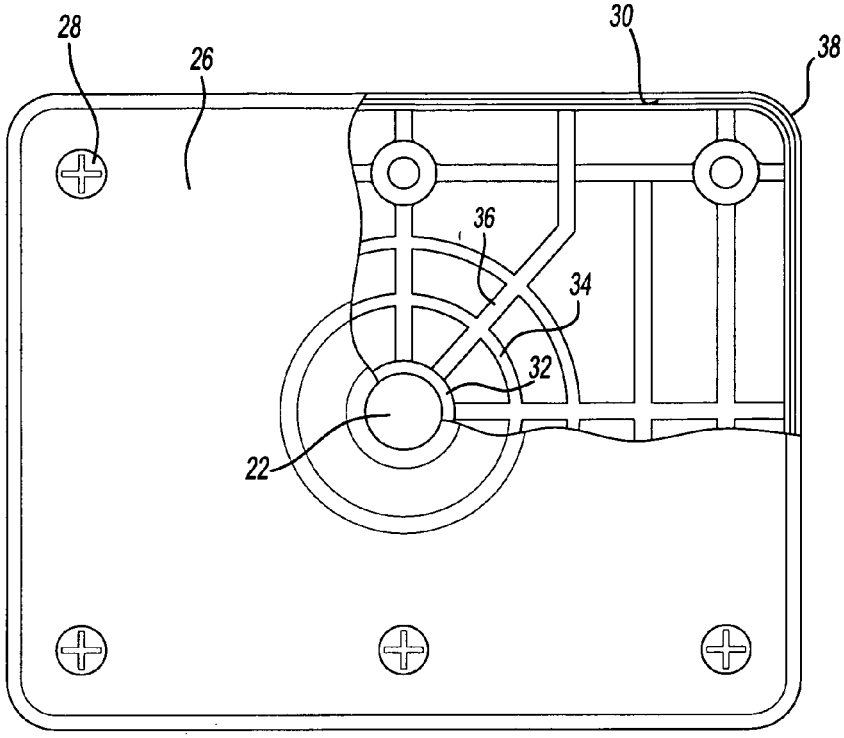
FIG. 2 is a view of the underside of the deck base of FIG. 1.

Moreover, as shown in FIG. 2, the underside of the deck base 26 includes an inner tube 32 that receives a portion of the seat pedestal 22 for mounting the seat pedestal. An outer concentric ring 34 provides additional support to the inner ring 32, along with frusto-conical supporting webs 36.

Further, as shown, a caulking groove 30 is formed at the outer periphery 38 of the deck base 26.

Figure 3:
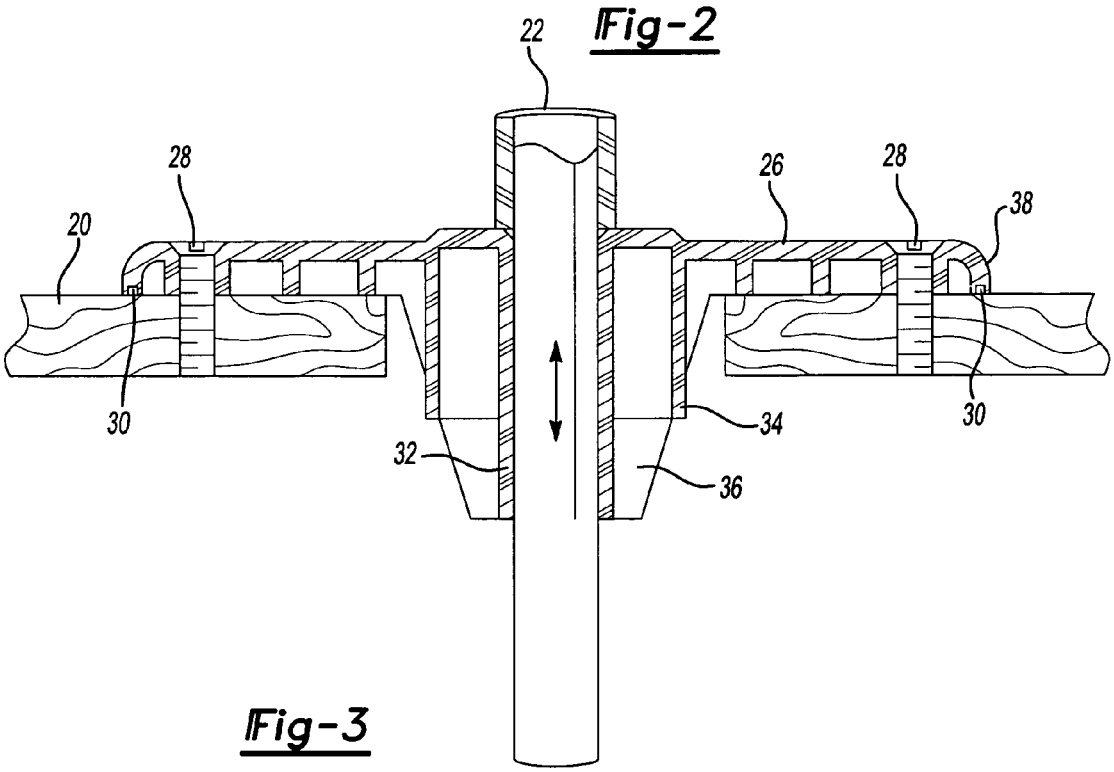
FIG. 3 is a cross-sectional view of the inventive deck base.

As shown in FIG. 3, the inner tube 32 extends downwardly to support the seat pedestal 22. The concentric ring 34 is connected to the inner ring 32 by the frusto-conical webs 36. The caulking groove 30 is formed adjacent the outer perimeter 38, and receives caulking to provide a water-tight seal between the deck base 26 and the deck 20.

The present invention thus eliminates the likelihood of breakage at the interface of the tube and the plate portion, and in addition eliminates problems due to corrosion.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A deck base comprising:

a generally planar plate, said plate having a central opening on an upper surface, and an integrally molded downwardly extending inner tube extending downwardly from said upper surface, and beyond a lower extent of said plate, and said inner tube and said plate being molded as a one-piece item; and wherein an outer support structure is molded outwardly of said inner tube to provide additional support to said inner tube, said outer support structure including a structure extending downwardly from said plate, said structure surrounding said inner tube, said outer support structure being positioned at an intermediate portion of said late between said central opening and an outermost extent of said plate, said outer support structure being spaced outwardly of said inner tube, but inwardly of said outermost extent.

2. A deck base as set forth in claim 1, wherein frusto-conical supporting webs connect said inner tube and said outer support structure.

3. A deck base as set forth in claim 1, wherein said inner tube structure is cylindrical, and webs connect said structure and said inner tube.

4. A boat comprising:

a deck;

a seat;

a deck plate for mounting said seat on said deck;

said deck plate including a central opening on an upper surface, and an integrally molded downwardly extending inner tube extending downwardly from said upper surface, and beyond a lower extent of said plate, and said inner tube and said plate being molded as a one-piece item; and an outer support structure is molded outwardly of said inner tube to provide additional support to said inner tube, said outer support surface begins positioned at an intermediate portion of said plate between said central opening and an outermost extent of said plate, said outer support structure being spaced outwardly of said inner tube, but inwardly of said outermost extent.

5. A boat as set forth in claim 4, wherein frusto-conical supporting webs connect said inner tube and said outer support structure.

6. A boat as sot forth in claim 4, wherein said outer support structure is cylindrical, and webs connect said outer support structure and said inner tube.

* * * * *

UNITED STATES PATENT AND TRADEMARK OFFICE

CERTIFICATE OF CORRECTION

PATENT NO. : 7,007,629 B2
APPLICATION NO. : 11/071628
DATED : March 7, 2006
INVENTOR(S) : Lewis, Jimmie L.

It is certified that error appears in the above-identified patent and that said Letters Patent is hereby corrected as shown below:

Column 2, Line 55: Please delete “late” and insert --plate--

Signed and Sealed this

Eighth Day of August, 2006

JON W. DUDAS
*Director of the United States Patent and Trademark Office*